United States Patent [19]

Brooks

[11] Patent Number: 4,703,955

[45] Date of Patent: Nov. 3, 1987

[54] CLEANING OF A BODY OF LIQUID

[75] Inventor: David A. Brooks, Roodepoort, South Africa

[73] Assignee: Orbijet Holdings (Proprietary) Limited, Germiston, South Africa

[21] Appl. No.: 850,708

[22] Filed: Apr. 11, 1986

Related U.S. Application Data

[62] Division of Ser. No. 710,069, Mar. 11, 1985, Pat. No. 4,652,366.

[30] Foreign Application Priority Data

Mar. 12, 1984 [ZA] South Africa ..... 84/1829

[51] Int. Cl.[4] ..... F16L 55/00

[52] U.S. Cl. ..... 285/119; 4/490

[58] Field of Search ..... 285/5, 6, 119; 4/490; 15/1.7; 134/167

[56] References Cited

U.S. PATENT DOCUMENTS

| | | | |
|---|---|---|---|
| 2,652,282 | 9/1953 | Willetts | 285/5 X |
| 3,741,238 | 6/1973 | Lacey | 285/5 X |
| 4,178,949 | 12/1979 | Mazon, III | 134/167 |
| 4,356,582 | 11/1982 | Stephenson | 15/1.7 |
| 4,467,962 | 8/1984 | Noble | 285/5 X |

FOREIGN PATENT DOCUMENTS

| | | | |
|---|---|---|---|
| 2211732 | 9/1973 | Fed. Rep. of Germany | 4/490 |

*Primary Examiner*—Dave W. Arola

[57] ABSTRACT

The invention comprises a cleaning head for a swimming pool cleaning apparatus and a surface unit for the apparatus. The cleaning head is pressure operated, having a main jet through which water exits, thereby displacing the cleaning head through the pool. The cleaning head also has a bag with a mouth facing in the direction of movement, which catches leaves and other dirt particles as it moves through the water. A scraper is also provided, which is hingedly attached to the head. The surface unit has a body which is rotatably attached to an inlet member which in turn is also rotatably attached to an outlet member. The inlet member is connected by means of a surface hose to a water return inlet of the pool and the outlet member is connected to the cleaning head by means of an underwater hose. The body of the surface unit has two jets which are directed in the same direction, with one being smaller than the other; so that the body is displaced linearly and also rotated. The body also carries a jet-operated, out of balance spinner, which causes a vibration that minimizes sticking of rotational joints. The surface and underwater hoses are in sections, that are joined together by various connectors. Thus, swivel connectors, connectors having jets and wheeled connectors are provided. Finally, the surface unit has compartments in which chemicals are stored and automatically dispensed into the pool.

6 Claims, 10 Drawing Figures

CLEANING OF A BODY OF LIQUID

This is a division of application Ser. No. 710,069, filed Mar. 11, 1985, now U.S. Pat. No. 4,652,366, Mar. 24, 1987.

THIS INVENTION relates to the cleaning of a body of liquid. In particular, it relates to various components of an apparatus for cleaning such a body of liquid and also to a surface defining the body, and to the apparatus itself.

According to the invention there is provided a cleaning head for an apparatus for cleaning a body of liquid, which includes a hollow body portion that carries a main jet member which defines a main jet wherethrough liquid may be discharged thereby to propel the body portion through the liquid;

a connecting means for connecting the body portion to a source of pressurised liquid, the connecting means and the main jet member being in fluid communication; and a detritus collecting means fast with the body portion and displaceable therewith for collecting detritus as the member passes through the liquid.

The detritus collecting means may comprise a foraminous structure, such as a bag, which has an inlet opening facing in an operative opposed direction to the main jet.

The main jet member may be located on one side of the body portion and at least one wheel may be rotatably mounted on the other side of the body portion.

The body portion may have an auxiliary jet member that is in fluid communication with the connecting means, has a smaller orifice than the main jet and is directed towards the inlet opening of the foraminous structure. A scraping member engageable with a surface of a container in which the liquid is contained may also be provided. The scraping member may be movably attached to the body portion, on the wheeled side thereof, to be displaceable toward and away from the body portion. This scraping member may then have an aerofoil section or may be angled so that it is displaced away from the body portion as the body portion moves through the liquid.

The connecting means may include a coupling for connection to a hose. The coupling may be swivelably attached to the body portion. The connecting means may also include a hose, one end of which is connected to the coupling. A secondary jet member that defines a secondary jet may be provided, fast with the hose intermediate its ends and in communication with the interior thereof. A flotation member and a wheeled member may also be secured to the hose. The or each wheel of the wheeled member may be rotational about an axis that is transverse to the longitudinal axis of the hose.

Further according to the invention there is provided a surface unit for an apparatus for cleaning a body of liquid, which includes an inlet connectable to a source of pressurised liquid and an outlet connectable to a cleaning head;

a flotation member for rendering the surface unit buoyant in the liquid; and a pair of displacing jet members that define displacing jets that are directed in substantially the same direction and are in communication with the inlet, for displacing the surface unit in the liquid, the displacing jet members being asymmetrical to produce, in use, a couple about a vertically disposed longitudinal axis as well as displacing the flotation member linearly. Thus, the displacing jet members may be equally spaced from the longitudinal axis and have orifices of different sizes.

A vibrating means may be provided for causing the flotation member to vibrate. The vibrating means may comprise an out-of-balance rotatable member that has a jet member that defines a vibrating jet in communication with the inlet, for causing rotation of the rotatable member.

The flotation member may be swivelably attached to a conduit member defining the inlet and outlet.

Further, the inlet may be defined by a tubular inlet member and the outlet may be defined by a tubular outlet member, and the inlet and outlet members may be swivelably attached to one another.

The flotation member may also have both closed and open compartments for chemicals.

The invention extends to an apparatus for cleaning a body of liquid which includes a cleaning head as described above and/or a surface unit as described above.

The invention is now described, by way of an example, with reference to the accompanying drawings, in which.

Figure 1:
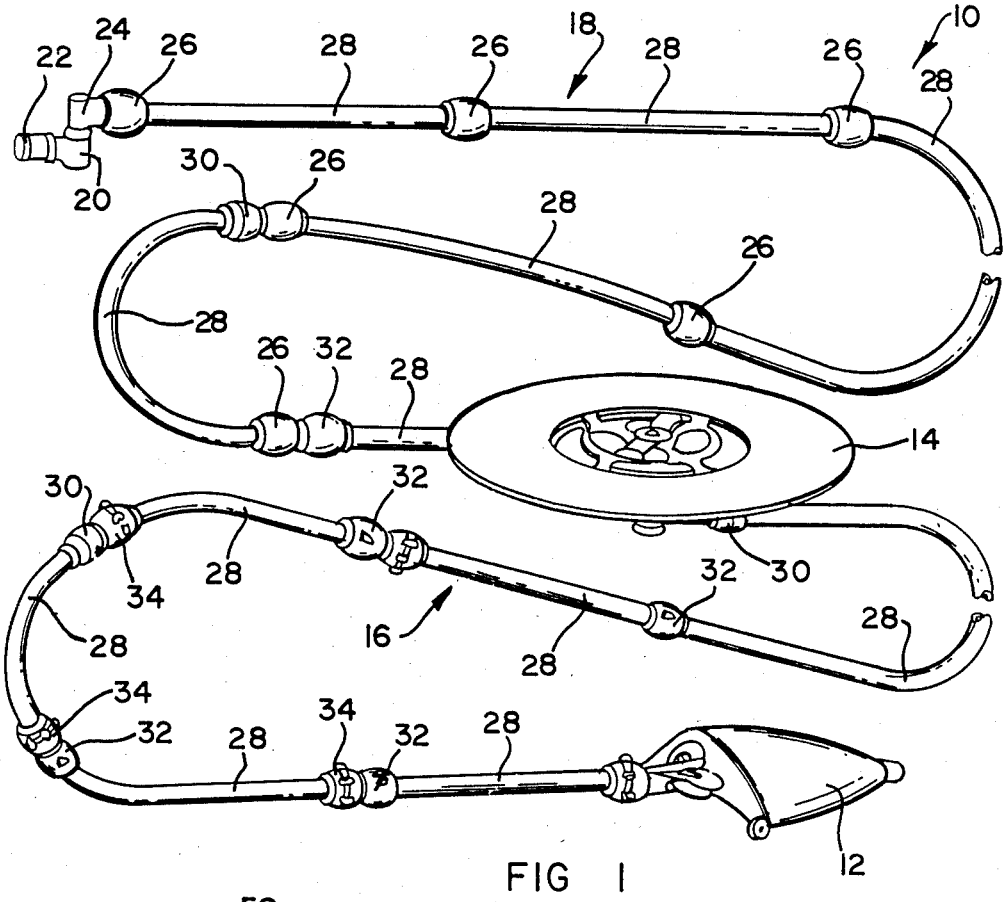
FIG. 1 shows a perspective view of a swimming pool cleaning apparatus in accordance with the invention.

Referring to the drawings, the swimming pool cleaning apparatus is designated generally by reference numeral 10. As will be explained below, the apparatus 10 operates by means of a pressure principle.

The apparatus 10 has two prime components - a cleaning head 12 and a surface unit 14. The cleaning head 12 is shown in more detail in FIGS. 2 and 3 and the surface unit 14 is shown in more detail in FIGS. 4, 5 and 6. The cleaning head 12 is connected to the surface unit 14 by means of an underwater hose 16 and the surface unit 14 is connected to an inlet of the swimming pool that is to be cleaned (not shown) through which water returns to the pool, by means of a surface hose 18 and a swivel connector 20.

The connector 20 has a tubular inlet 22 which is engaged with the inlet of the swimming pool and an outlet 24 which is connected to the hose 18 by means of a connector 26. The inlet 22 and outlet 24 are swivably connected to one another. The hose 18 comprises sections 28 which are connected to one another by means of connectors 26, 30 and 32. The connectors 26 have buoyant elements which cause the hose 18 to float on the surface. The connectors 30 are swivel connectors and are shown more clearly in FIG. 9. The connectors 32 have jets and are shown more clearly in FIG. 7.

Similarly, the underwater hose 16 has sections 28 that are the same as those for the surface hose 18, the sections 28 being connected to one another by jet connectors 32, the swivel connectors 30 and wheeled connectors 34. The wheeled connectors 34 are shown in more detail in FIG. 8.

Figure 2:
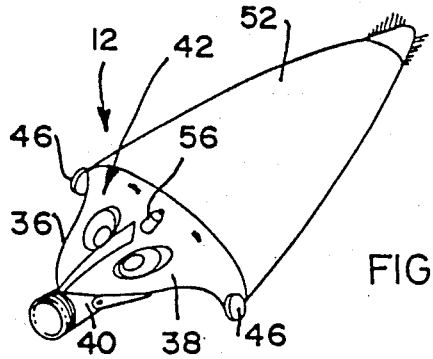
FIG. 2 shows a plan view of a cleaning head of the apparatus.
Figure 3:
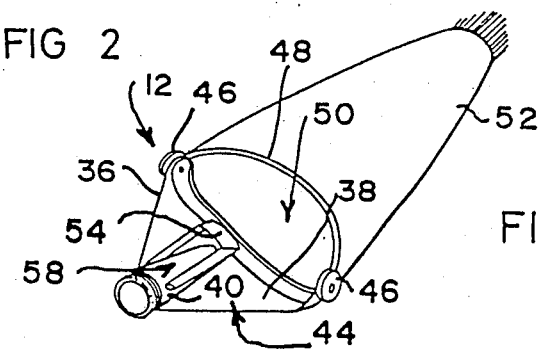
FIG. 3 shows an underneath plan view of the cleaning head.

Turning now to FIGS. 2 and 3, the cleaning head 12 is shown. The cleaning head 12 has a body portion 36 that comprises a curved section 38 and a hollow central section 40. The curved section 38 is curved to define a convex side 42 and a concave side 44. At the ends of the curved section 38 wheels 46 are provided. A curved support member 48 is also connected to the ends of the curved section 38 to define a mouth 50. The support member 48 also performs a scraping function. A woven bag 52 is secured to the support member 48 and the curved section 38 such that, as the body portion 36 is displaced through the water (in a manner which will be described below) water with detritus suspended therein flows into the bag 52 through the mouth 50, with detritus being collected in the bag 52. A scraper member 54 which is angled with respect to the body portion 36 and which is hingedly attached thereto, on the convex side 44 of the body portion 36, is also provided. The scraper 54 is angled such that it is displaced away from the body portion 36 as the body portion 36 is displaced through the water. The body portion 36 is displaced through the water by means of a main jet 56 which projects from the convex side 42 of the body portion 36 and is angled thereto, pointing in the general direction of the bag 52 and keeping the wheels 46 in contact with the walls or floor of the pool. The jet 56 communicates with the interior of the hollow section 40. A smaller auxiliary jet 58 is provided on the other side of the body portion 36 and is angled towards the mouth 50 to assist the passage of detritus into the bag 52. It will be appreciated, that in use, water flowing out of the main jet 56 causes the cleaning head 12 to be displaced through the water and to have a component of thrust towards the wheels 46.

Figure 4:
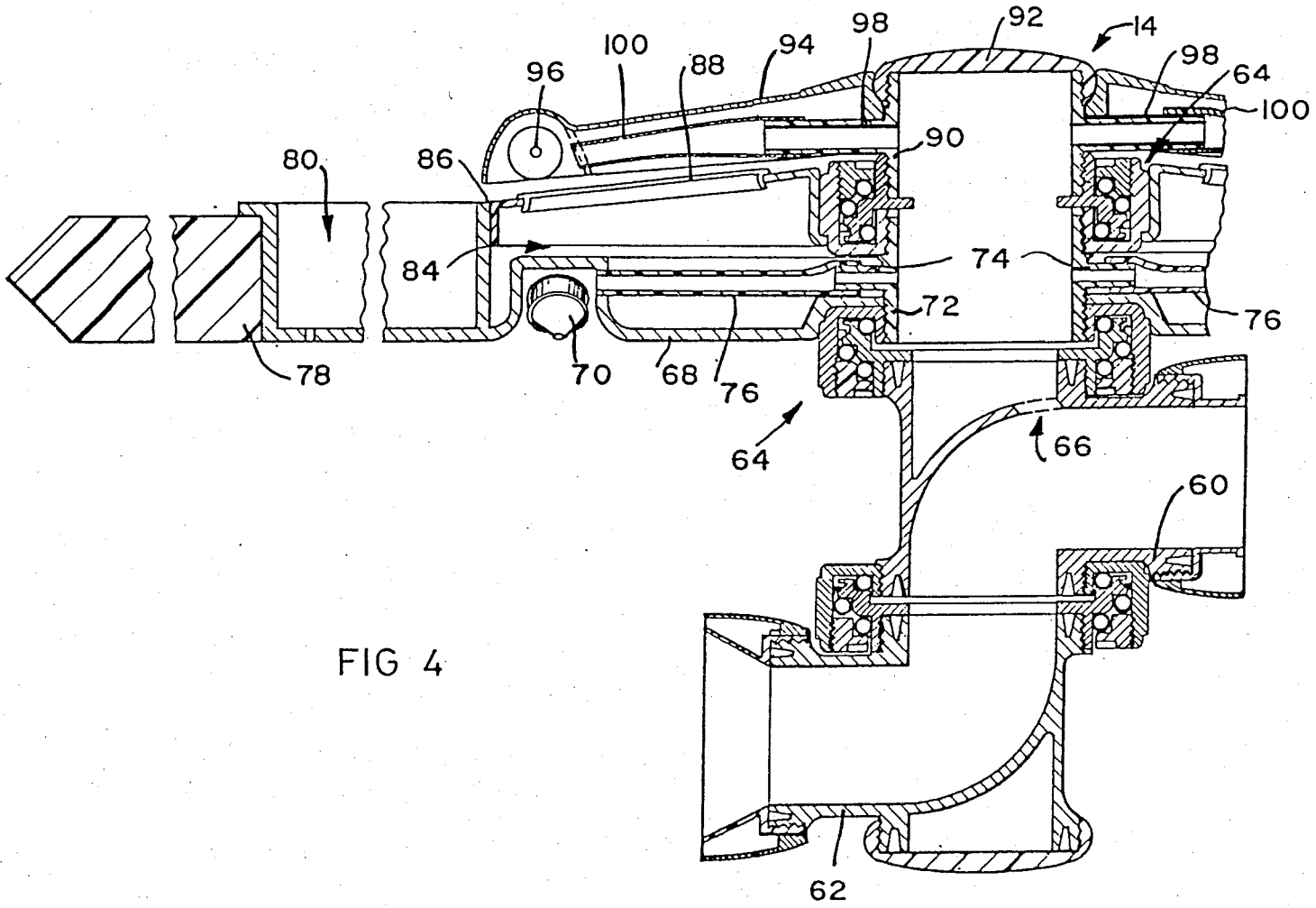
FIG. 4 shows a sectioned view of part of a surface unit of the apparatus.
Figure 5:
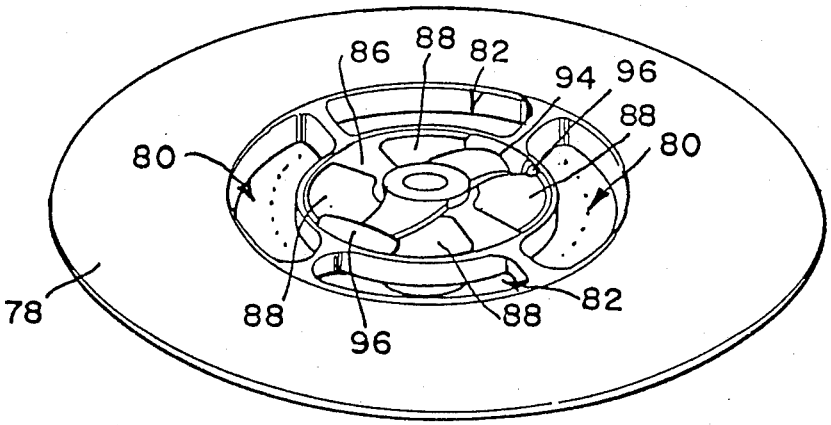
FIG. 5 shows an oblique plan view of the surface unit.
Figure 6:
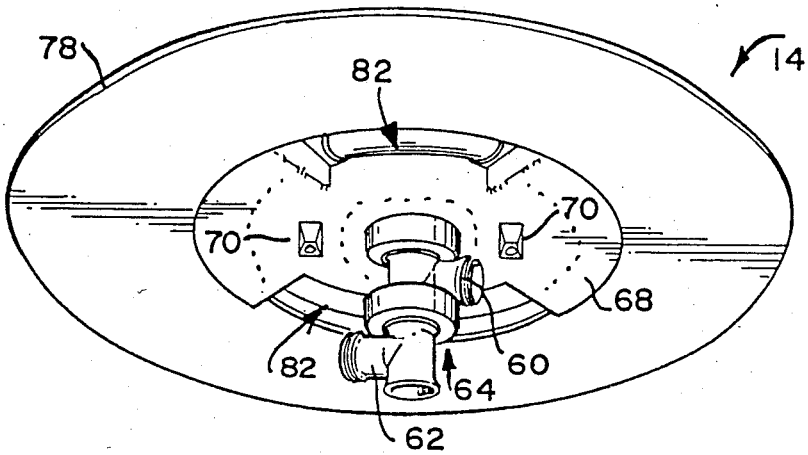
FIG. 6 shows an oblique underneath view of the surface unit.

Turning now to FIGS. 4, 5 and 6, the surface unit 14 is shown therein. The surface unit 14 has a tubular inlet member 60 that is cranked and a tubular outlet member 62 that is also cranked. The surface hose 18 is connected to the inlet member 60 and the underwater hose 16 is connected to the outlet member 62. The two members 60 and 62 are connected together by means of a bearing arrangement 64 so that they are swivelable with respect to a swivel axis which is vertically disposed in use. The inlet member 60 further has an aperture 66 through which water is supplied to further jets incorporated in the surface unit 14. Thus, the surface unit has a main tray 68 which is rotatably attached to the inlet member 60 by means of a further bearing arrangement 64 and carries two displacing jets 70 (only one of which is shown in FIG. 4) which project from the underneath surface of the tray 68 at an angle, as is shown in FIG. 6. The tray 68 is secured to a first tubular carrier 72 which in turn is connected to the inlet member 60 by means of a further bearing arrangement 64, to be in communication with the aperture 66. This carrier 72 has two spigots 74 which are connected to the jets 70 by means of pipes 76. Although the jets 70 are equally spaced from a central axis of the tray 68, and are angled in the same direction, one of the jets is smaller than the other. Thus, in use, as water exits from the jets 70 the tray 68 will be displaced linearly through the water and will also be rotated about the inlet member 60, which in turn will cause the above-mentioned vector of linear thrust to change its alignment relative to the pool-shell.

Secured to the periphery of the central tray 68 is a ring 78 of foamed plastic which causes the surface unit 14 to float in the water. Further, the central tray 68 has two outer compartments 80 for the dispersal of liquid or powdered chemicals, two openings 82 and an annular dished region 84 for the containment of chemical tablets. A cover 86 closes off this dished region 84. The cover 86 has four openings (for the insertion of tablets which are closed by removable lids 88.

A second tubular carrier 90 is secured to the first carrier tube 72 by means of a further bearing arrangement 64 such that the carriers 90 and 72 are in communication with one another. The second carrier 90 is closed off by means of a cap 92. An off-balance spinner 94 is secured to the second carrier 90. The spinner 94 has two opposed jets 96 which are connected to spigots 98 of the second carrier 90 by means of pipes 100. In use, the spinner 94 is caused to rotate due to water exiting the jets 96. Because the spinner 94 is not balanced, this imparts a vibration to the surface unit 14 which inhibits sticking of the bearing arrangements 64, thus facilitating the constant and random realignment of the asymmetrical jets 70 of the surface unit 14 relative to the surface hose 18, and of the surface hose 18 relative to the underwater hose 16. Additionally, this vibration causes a pulsation down the length of both hoses 16 and 18, inhibiting their coming to rest against the pool-shell.

Figure 7:
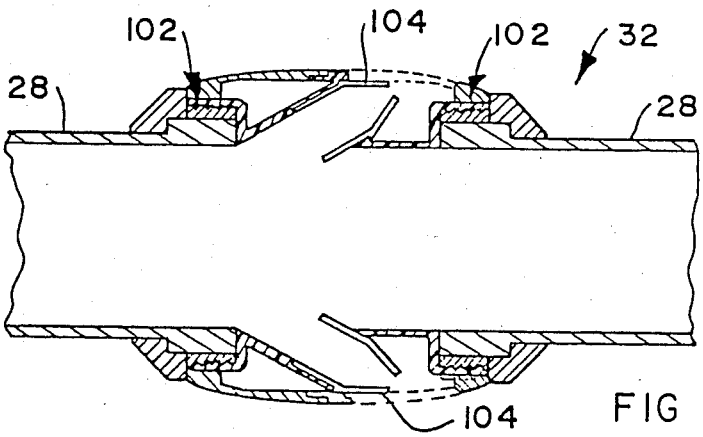
FIG. 7 shows a sectioned view of a jet connector which connects together two sections of hose of the apparatus.

Referring now to FIG. 7, a jet connector 32 is shown therein. The connector 32 has thread formations 102 at each end by means of which the hose sections 28 are secured thereto, and also incorporates cavities to hold weights for the attainment of optimum buoyancy of underwater hose 16. The connector 32 also has either one or two angled jets 104 which communicate with the interior thereof. It will be understood that in use water flows out of the jets 104 causing the connector 32 to be displaced in the water, thereby also moving the hose sections 28. Where two jets 104 are employed the resultant line of thrust is along the longitudinal axis of the hose 16, but where only one jet 104 is employed there is an additional component of thrust at right angles to this axis. The two or three jet connections 32 closest to the cleaning head 12 will have only one jet 104 each. The section of underwater hose 16 on which they occur will remain unswivelably fixed relative to the cleaning head 12, but swivelably fixed relative to the rest of the underwater hose 16. The line of thrust of each will be in the same plane as that of the main jet 56, and in view of the transverse component of thrust possessed by all these jets, the cleaning head 12 will be mostly held in contact with the walls and floor of the pool, and when it does break away will soon automatically correct its attitude and restore its wheel-to-wall/floor contact.

Figure 8:
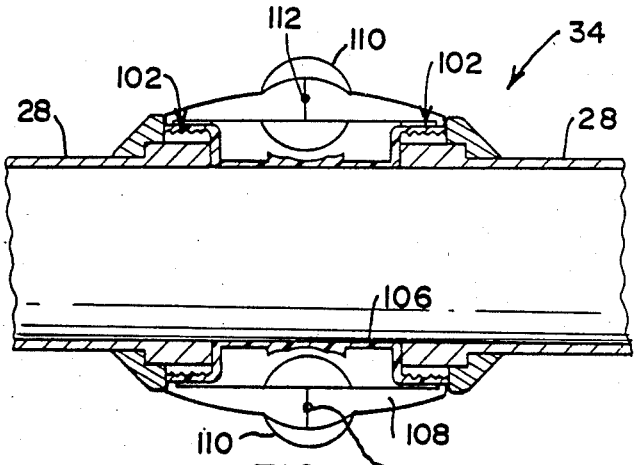
FIG. 8 shows a sectioned view of a wheeled connector.

Referring to FIG. 8, the wheeled connector 34 is shown therein. The connector 34 has a tubular body 106 which has threaded formations 102 for connection to the hose sections 28, as with the connector 32. A cage 108 is rotatably mounted on the body portion 106 to be rotatable about a longitudinal axis of the body portion 106. The cage 108 carries eight wheels 110 which are rotatable about axles 112 that are transverse to the longitudinal axis. Thus, as the hose sections 28 are displaced through the water, every now and again the hose sections 28 will tend to rub against wall or floor portions of the swimming pool. At these times, the wheels of the connectors 34 will engage the walls or floor thereby protecting the hose sections 28 and facilitating movement of the underwater hose through the water both in the direction of its longitudinal axis and at right angles to it.

Figure 9:
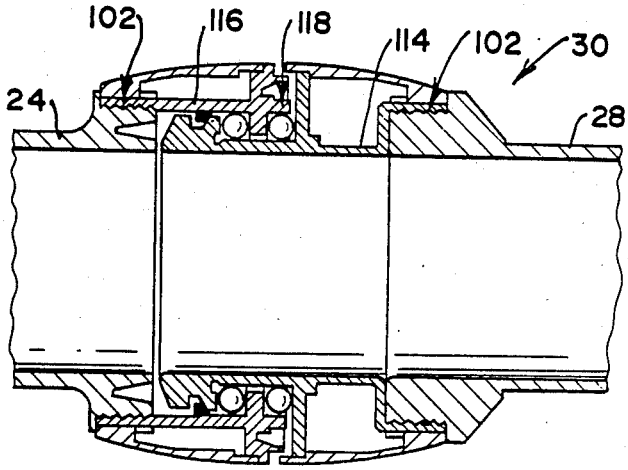
FIG. 9 shows a sectioned view of a swivel connector.

Referring to FIG. 9, a swivel connector 30 is shown. The swivel connector 30 has tubular portions 114 and 116 which each have threaded regions 102 and are swivably connected to one another by means of a bearing arrangement 118. By means of the bearing arrangement 118 the members 114 and 116 are able to rotate with respect to one another. Thus, adjacent hose sections 28 may rotate with respect to one another, thus randomly altering the resultant directions of thrust of those jet connectors 32 having only one angled jet 104.

Figure 10:
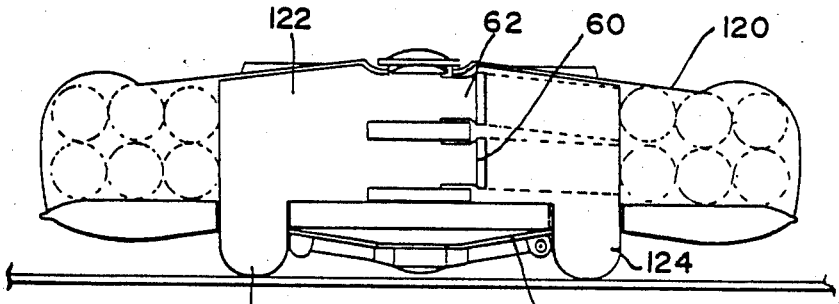
FIG. 10 shows schematically how the surface unit is utilised to store hoses of the apparatus.

Finally, referring to FIG. 10, the surface unit 14 is shown in an inverted position with a reel unit 120 that is utilised to roll up the surface hose 18 and underwater hose 16 about a core 122 that has feet 124 which project through the apertures 82 in the central tray 68.

It will accordingly be understood that when the apparatus 10 is in use, the cleaning head 12 is caused to move through the water collecting dirt therein. Due to the action of the main jet 56 and the jets 104 of the connectors 32 the underwater hose 28 and the cleaning head 12 move randomly through the swimming pool. Further, due to the inter-dependent action of the jet connectors 32, the swivel connectors 30 and the wheel connectors 34 the possibility of the cleaning head 12 being caught in any part of the pool is extremely small. Further, due to the constant and random realignment of these components the possibility of the cleaning head 12 moving through a repeating pattern is also very small. Further, as the surface unit 14 itself moves randomly around the pool the randomness of movement of the cleaning head 12 is enhanced. It will also be appreciated that if the surface unit 14 comes into contact with a wall portion of the swimming pool, it will rotate as it moves along the wall, thus overpowering the lesser tendency to rotate caused by the asymmetrical jets 70 (in conjunction with the vibration caused by the spinner 94). The more sudden and vigorous realignment of the linear thrust vector of the jets 70 further enhances the randomness of the entire system. When this line of linear thrust is opposed to the direction of movement of the underwater hose 16, the latter slows down and "snakes" randomly in both the horizontal and vertical planes. When the linear thrust of these jets 70 is in the same direction as the movement of the underwater hose 16, the latter speeds up and proceeds from one area of the pool to another by a more direct route, tending to follow the equally rapid passage of the surface unit 14.

I claim:

1. An accessory for use with a hose, comprising: a tubular body member which defines a longitudinal axis and which has means for connection to the hose so that said member is in line with the hose; and means for mounting a plurality of wheels mounted on the body member so that all the wheels are together rotatable about the longitudinal axis and each wheel is also rotatable about an axis that is transverse to the longitudinal axis.

2. An accessory as claimed in claim 1, in which each transverse axis is tangential to a circle around the longitudinal axis.

3. An accessory as claimed in claim 1, in which said means for mounting said plurality of wheels includes a cage that is mounted on the body member to be rotatable thereabout.

4. An accessory as claimed in claim 2, in which said means for mounting said plurality of wheels includes a cage that is mounted on the body member to be rotatable thereabout.

5. An accessory as claimed in claim 1, in which the connection means are coupling formations at the ends of the body member.

6. A hose for an automatic swimming pool cleaner, comprising an accessory having a tubular body member which defines a longitudinal axis and has means for connection to the hose so that the body member is connectable in line with the hose; and means for mounting a plurality of wheels mounted on the body member so that all the wheels are together rotatable about the longitudinal axis and each wheel is also rotatable about an axis that is transverse to the longitudinal axis.

* * * * *

UNITED STATES PATENT AND TRADEMARK OFFICE

CERTIFICATE OF CORRECTION

PATENT NO. : 4,703,955

DATED : November 3, 1987

INVENTOR(S) : David A. Brooks

It is certified that error appears in the above-identified patent and that said Letters Patent are hereby corrected as shown below:

Column 6, line 14 (Claim 1, line 5), delete "mounted";

Column 6, line 39 (Claim 6, line 6), delete "mounted".

Signed and Sealed this

Seventeenth Day of January, 1989

*Attest:*

DONALD J. QUIGG

*Attesting Officer*

*Commissioner of Patents and Trademarks*